US008813851B2

(12) United States Patent
Varley et al.

(10) Patent No.: US 8,813,851 B2
(45) Date of Patent: Aug. 26, 2014

(54) METHOD OF CONNECTING A FLEXIBLE RISER TO AN UPPER RISER ASSEMBLY

(75) Inventors: Mark Lawrence Varley, Wylam (GB); Wilfred Johnson Emmanuel Cox, Hayes (GB)

(73) Assignee: Subsea 7 Limited, Sutton (GB)

( * ) Notice: Subject to any disclaimer, the term of this patent is extended or adjusted under 35 U.S.C. 154(b) by 268 days.

(21) Appl. No.: 13/257,251

(22) PCT Filed: Mar. 10, 2010

(86) PCT No.: PCT/EP2010/053033
§ 371 (c)(1),
(2), (4) Date: Feb. 21, 2012

(87) PCT Pub. No.: WO2010/105953
PCT Pub. Date: Sep. 23, 2010

(65) Prior Publication Data

US 2012/0145407 A1 Jun. 14, 2012

(30) Foreign Application Priority Data

Mar. 16, 2009 (GB) ..... 0904494.2

(51) Int. Cl.
*E21B 17/01* (2006.01)

(52) U.S. Cl.
USPC ..... 166/345; 166/350; 166/367

(58) Field of Classification Search
USPC ..... 166/338, 340, 343, 345, 352, 367, 85.1; 405/169, 224.2, 224.3
See application file for complete search history.

(56) References Cited

U.S. PATENT DOCUMENTS

| | | | | |
|---|---|---|---|---|
| 3,534,984 | A | 10/1970 | Shuey | |
| 3,599,436 | A | 8/1971 | Lochridge et al. | |
| 3,717,002 | A | 2/1973 | O'Brien et al. | |
| 4,284,143 | A | 8/1981 | Scherrer et al. | |
| 4,643,614 | A * | 2/1987 | Laursen | 405/169 |
| 4,886,395 | A * | 12/1989 | Moles et al. | 405/169 |
| 5,676,209 | A | 10/1997 | Reynolds | |
| 5,807,027 | A * | 9/1998 | Ostergaard | 405/170 |
| 2004/0265066 | A1 * | 12/2004 | Mackinnon | 405/170 |
| 2008/0302535 | A1 | 12/2008 | Barnes | |

FOREIGN PATENT DOCUMENTS

| | | |
|---|---|---|
| GB | 2 207 475 | 2/1989 |
| GB | 2 300 439 | 11/1996 |
| GB | 2 323 907 | 10/1998 |
| GB | 2 348 450 | 10/2000 |
| GB | 2 382 635 | 6/2003 |

OTHER PUBLICATIONS

Curewitz, D. et al., "D/V Chikyu: Riser Operations and the Future of Scientific Ocean Drilling," 19 Oceanography 4, pp. 168-172 (Dec. 2006).

* cited by examiner

*Primary Examiner* — Matthew Buck
*Assistant Examiner* — Stacy Warren
(74) *Attorney, Agent, or Firm* — Levy & Grandinetti

(57) ABSTRACT

A method is described for connecting a flexible upper riser part to a lower riser part via an upper riser assembly supporting a lower riser termination. The method includes securing a cable linkage to a riser connector at the lower end of the flexible upper riser part. The method includes operating a winching means on the upper riser assembly to wind in the cable linkage and draw the riser connector into a docking position on the upper riser assembly. Then coupling the riser connector to the lower riser termination occurs. A corresponding method of disconnecting the flexible riser part is also described, as well as a method of mounting the winching mechanism on a submerged landing platform.

20 Claims, 11 Drawing Sheets

METHOD OF CONNECTING A FLEXIBLE RISER TO AN UPPER RISER ASSEMBLY

CROSS-REFERENCE TO RELATED APPLICATIONS

This Application is the U.S. National Phase of International Application Number PCT/EP2010/053033, filed on Mar. 10, 2010, which claims priority to Great Britain Application Number 0904494.2, filed on Mar. 16, 2009.

BACKGROUND OF THE INVENTION (1) Field of the Invention

The present invention relates to methods of connecting a flexible upper riser part to a lower riser part of a hybrid riser via an upper riser assembly.

The basics of riser drilling are described and illustrated in "D/V Chikyu, Riser Operations and the Future of Scientific Ocean Drilling" published in Oceanography, Vol. 19, No. 4, December 2006. Here it is described that riser drilling involves several steps that are accomplished in a variety of ways depending on specific technological packages, water depths and bottom conditions. First, a wide diameter pilot hole is drilled and cased, then a specialized wellhead is provided to anchor a pressure sensor and finally a shut-off valve assembly, called a blow-out preventer (BOP), is installed. The BOP itself may be lowered to the wellhead and attached using a remotely operated vehicle (ROV). Lowering of the BOP is accomplished by successively attaching sections of riser pipe to the top of the BOP and lowering them to the sea floor. Riser pipe itself comprises wide diameter high-strength pipe with external conduits for cables and connectors to allow control and monitoring of the BOP. Once the BOP is installed at the wellhead and linked to the drilling vessel via the riser pipes, drilling and coring, as well as any downhole logging, measurement operations or sampling operations can begin.

More recently, the free-standing hybrid riser (FSHR) system has been developed as an attractive solution for deep water operations due to its much reduced dynamic response as a result of significant motion decoupling between the vessel and the riser and due to the same vessel interface loads that it presents when compared with steel catenary risers (SCRs) or flexible pipe solutions.

A deep water riser assembly of this type is described in U.S. Pat. No. 5,676,209. The assembly includes a lower blow-out preventer (BOP) stack positioned adjacent and anchored to the bottom of the ocean and an upper BOP stack attached to the riser at water level, but just far enough below the water surface to be unaffected by surface currents. The upper BOP stack has shear rams above the pipe rams to sever the section of the drill pipe above the shear rams and allow the upper section of the drill pipe between the shear rams and the drill ship to be retrieved followed by the section of riser above the upper BOP stack. This frees the drill ship to move as required in order better to weather a surface storm. A floatation module is attached to the riser below the upper BOP stack and exerts an upward force that holds the riser below the upper BOP stack free standing and in tension. Means are provided to reconnect the upper section of the riser to the upper BOP stack after the storm has passed.

(2) Description of Related Art

Another related riser design is described in US Publication No. US 2008/0302535 A1. In this document, a multi-component system for subsea intervention is described. The system comprises a lower riser component which is held vertical by a buoyancy element and an upper riser system. The upper riser system comprises a continuous enjoined conduit with sufficient flexibility to absorb the motion of the deployment vessel without adversely affecting the function of the intervention system.

In one known FSHR system, a single vertical steel pipe connected to a foundation pile at the sea bed. The system is tensioned using a nitrogen-filled buoyancy tank which is mechanically connected to the riser. In one variant, the riser pipe runs through the bore of the buoyancy tank which is located below the mean water level out of a wave and high current zone. At the top of the buoyancy tank a goose neck assembly is provided, to which a flexible juniper on the riser is attached to link the riser to the vessel, thus essentially decoupling the free-standing riser from the vessel motions.

In systems where a central pipe runs through the centre of the buoyancy tank, this acts as the main structural element in the buoyancy tank. Internal bulk heads are used to divide the tank into sub-compartments. The riser pipe is attached to a load shoulder on the top of the buoyancy tank and thus the upthrust generated by the buoyancy tank is transmitted directly to the pipe to provide tension in the riser string.

The goose neck assembly provides fluid take off from the free-standing riser to the flexible jumper. It comprises an induction bend and is structurally braced back to a goose neck support spool at the base of the assembly to react the loads generated by the flexible jumper. Positioning of the goose neck at the top of the buoyancy tank allows for independent installation of vertical riser and flexible jumper. The flexible pipe installation vessel can install the flexible jumper at a convenient time. This minimizes the risk of damage to the flexible jumper during installation as the procedure is similar to that of a shallow water flexible riser with the first end at the top of the buoyancy tank.

However, the position of the goose neck relative to the buoyancy tank can be varied. In an alternative design, the goose neck is positioned below the buoyancy tank and the vertical riser is tensioned by the tank via a flexible linkage. This arrangement simplifies the interface between the buoyancy tank and the vertical riser and allows preassembly of the flexible jumper to the goose neck before deployment of the vertical riser. However, in the known systems, in the event of a flexible jumper replacement or repair, an elaborate jumper disconnection system has to be employed below the buoyancy tank.

Reference is also made to U.S. Pat. No. 3,717,002 A, which discloses, with reference to FIG. 15 thereof, a method and apparatus for lowering from a platform a constructed, vertical, upper riser into mating and interconnecting engagement with an underwater connecting end at the upper end of an underwater pipeline. A crane used for lowering the constructed pipeline on a first cable onto the pipeline connecting end also supports a coupling cable which passes down through the constructed riser and is connected, by means of a hook on the end of the cable, to a guide coupling assembly positioned on the underwater connecting end of the underwater pipeline. The vertical riser would appear to be made up of individual interconnected rigid riser sections.

BRIEF SUMMARY OF THE INVENTION

An object of the invention is to provide an improved method of connecting a flexible upper riser component onto the lower riser component of a hybrid riser.

Another object of the invention provides a simple and practical method of connecting a flexible riser component to a lower riser termination without the need for diver intervention.

According to a first aspect of the invention, there is provided a method of connecting a flexible upper riser part to a lower riser part via an upper riser assembly supporting a lower riser termination on the lower riser part, the lower riser part rising from the sea bed and the upper riser part being connected, in mid-water, to continue the lower riser part to a surface facility, the method comprising: lowering the flexible upper riser part and a riser connector at the lower end of the flexible upper riser part to a position adjacent the upper riser assembly; securing a cable linkage to the riser connector; operating a winching means on the upper riser assembly to wind in the cable linkage and draw the riser connector into a docking position on the upper riser assembly; and coupling the riser connector to the lower riser termination.

The cable linkage preferably comprises two or more winch cables, which may be steel or synthetic.

In a preliminary operation, a winch platform carrying the winching means is preferably lowered to the upper riser assembly and docked with the upper riser assembly by means of a remotely operated vehicle (ROV).

A further remotely operated vehicle preferably provides power to the winching means.

The flexible upper riser part and its riser connector are preferably lowered into a position adjacent the upper riser connector, the cable linkage is then attached to the riser connector by using an ROV, and the cable linkage is drawn in to pull the riser connector into said docking position. Any suitable cable anchoring device can be used to secure the cable linkage to the riser connector. In the specific embodiment described below, the cables of the cable linkage are provided with male ball-type connectors, which mate with corresponding female connectors on the riser connector.

Preferably, a remotely operated vehicle is employed to secure the cable linkage to the riser connector, to couple the riser connector to the lower riser termination and to disconnect the cable linkage from the riser connector.

Preferably, all connection and disconnection operations are performed with a remotely operated vehicle.

Expediently, said cable linkage is threaded through ducting means alongside the lower riser termination by means of a remotely operated vehicle.

According to a second aspect of the invention, there is provided a method of disconnecting a flexible upper riser part from a lower riser part via an upper riser assembly supporting a lower riser termination on the lower riser part, the lower riser part rising from the sea bed and the upper riser part being connected, in mid-water, to continue the lower riser part to a surface facility, the method comprising: securing a cable linkage to a riser connector at the lower end of the flexible upper riser part; decoupling the riser connector from the lower riser termination; operating a winching means on the upper riser assembly to unwind the cable linkage and withdraw the riser connector from its docking position on the upper riser assembly; and retrieving the flexible upper riser part and its riser connector from a position adjacent the upper riser assembly.

Preferably, the disconnecting method further comprises disconnecting the cable linkage from the riser connector after it has been withdrawn from the docking position.

Expediently, said cable linkage comprises two or more winch cables, which may be steel or synthetic.

In a preferred variant, a winch platform carrying said winching means is lowered to the upper riser assembly and docked with the upper riser assembly by means of a remotely operated vehicle.

Preferably, a further remotely operated vehicle provides power to the winching means.

Expediently, the riser connector is hoisted up by a lifting device and loading is transferred from the cable linkage to the lifting device after the riser connector is withdrawn from said docking position.

Preferably, a remotely operated vehicle is employed to secure the cable linkage to the riser connector, to decouple the riser connector from the lower riser termination and to disconnect the cable linkage from the riser connector.

Also disclosed herein is a method of mounting a winching mechanism on a submerged landing platform comprising: lowering a winch platform carrying said winching mechanism to the vicinity of said submerged landing platform; and using a remotely operated vehicle to guide the winch platform into position on said landing platform.

Preferably, said remotely operated vehicle is employed to secure the winch platform onto said landing platform.

Said remotely operated vehicle is preferably employed to thread a cable from said winching mechanism into an operational position.

Preferably, said remotely operated vehicle is coupled to said winch platform to provide operating power to said winch platform for operating said winching mechanism.

For a better understanding of the invention, and to show how the same may be carried into effect, reference will now be made by way of example, to the accompanying drawings, in which:

DESCRIPTION OF THE DRAWINGS

FIGS. 1 to 9 show sequential steps in the connection of a flexible riser part to the upper riser assembly;

Corresponding components are designated with the same reference signs throughout the drawings.

DETAILED DESCRIPTION OF THE INVENTION

A hybrid riser comprises a lower steel riser section 3 that rises from the sea bed to a sub-surface tank 1, beneath which a flexible riser component will be connected to continue the riser to the surface facility.

Installation of the flexible riser component onto a goose neck 4 of the upper riser assembly (URA) 2 of a single line hybrid riser (SLHR) in mid water, at an angle of typically about 20° from the vertical, is an operation which requires the development of a method of installation which is both safe and reliable. The method of installation must also be sufficiently controlled and precise to avoid damaging the relatively delicate flexible riser. Using the system herein described, this operation can be carried out at depths below which divers can safely or conveniently operate.

In summary, it is proposed to use a subsea winch system to assist in the remote installation operation of the flexible riser in the field.

Figure 1:
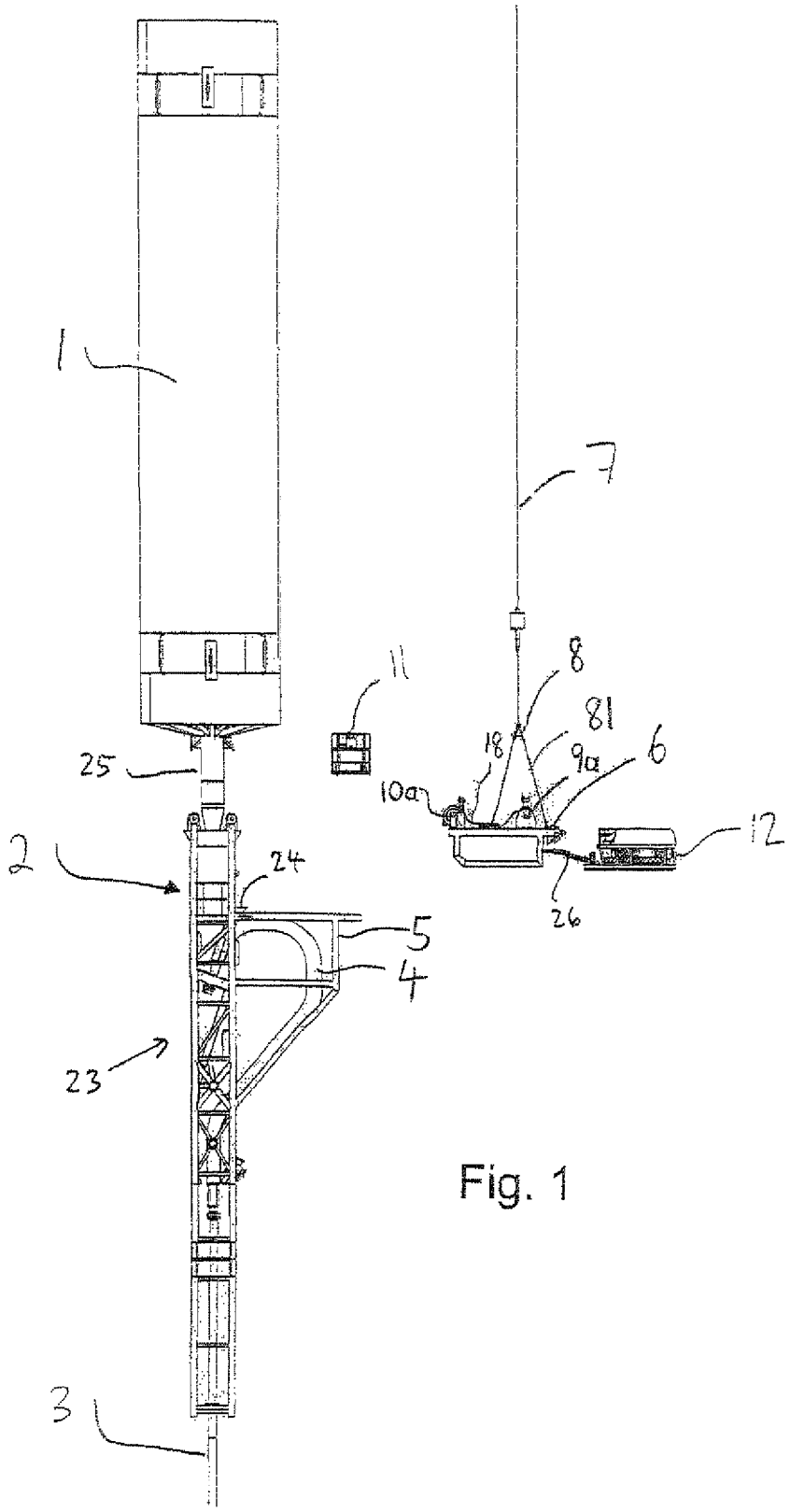
FIGS. 1 to 9 each show an elevational view of the upper part of a hybrid riser, including the buoyancy tank.

Referring to FIG. 1, a buoyancy tank 1 suspends an upper riser assembly 2 via a flexible coupling 25. In turn, the upper riser assembly 2 supports a riser conduit 3. The riser conduit 3 passes upwardly through the upper riser assembly 2 and into a goose neck termination 4. A landing frame 5 extends laterally from one side of the upper riser assembly 2, and serves to protect the goose neck termination 4.

FIG. 1 also shows a winch platform 6 being lowered from a support vessel by means of a crane cable 7. The cable 7 is connected to a spreader beam 8, from each end of which the winch platform 6 is suspended by cables 81. Alternatively, any other attachment mechanism could be employed. For example, a four-leg sling could be employed, with no spreader beam. The winch platform 6 carries first and second winches 9*a* and 9*b* and corresponding first and second sheaves 10*a* and 10*b*. The winches 9*a*, 9*b* are equipped with steel or synthetic cabling 18. More detail of the winch platform is visible in FIG. 10.

FIG. 1 further shows first and second remotely operated vehicles (ROVs) 11 and 12, which, although essentially interchangeable, will be rigged differently for the purposes of the installation procedure. Each will be provided with observation cameras.

The winch system includes an ROV control panel designed to accept hydraulic coupling from an ROV 12 through a dual port hot stab arrangement, or three port if a case drain is required.

The winch platform 6 includes a brake release mechanism that is designed to operate upon application of hydraulic drive pressure and flow, (i.e. the brake will be "fail safe"). This provides a fail safe method of locking the winch drum in the event of transmission failure.

The brake release mechanism, along with the internal motor case drains, is incorporated into the winch assembly. Therefore the winch will be operable with a supply and return line connection from the ROV 12. The direction of rotation of the winch will be controlled via a valve on the ROV panel, which is manipulated by an operating arm 26 of the ROV 12.

It is a requirement that the winch does not run freely under any circumstances during the winching operation. The brake provided on respective winch drum are rated to take at least 22.5 metric tons in accordance with the maximum load requirement.

The ROV 12 includes a manipulator 26, and has the capabilities of:

supplying hydraulic fluid; and controlling isolation valves and direction control valves through use of the manipulator 26.

The winch platform 6 further includes a load readout device which allows tension reading on both winches 9*a*, 9*b*. Each winch has its own readout clearly marked giving the load in metric tons, for example, and visible to the ROV cameras. The readout will be accurate to within 5% of the total applied load.

Electrically powered load cells are provided on each sheave 10*a*, 10*b*, preferably battery powered with a back-up electrical supply from the ROV 12.

The load span of the system/display is, for example, between 1.0 metric tons min and 20.0 metric tons max on each winch motor/drum assembly.

It is preferable that only one ROV at a time will operate the winches 9*a*, 9*b* and all functions have clear unambiguous labelling. The winch system has the ability to operate in the following modes:

Drive Mode:

This is selectable and deselectable on the winch mounted ROV panel via a valve operated by the ROV manipulator. The status of this valve can be set to synchronized mode or independent mode. When sychronized mode is selected, both winches 9*a*, 9*b* will be synchronized and driven in either direction dependent on flow of pressure inputs from other valves on the ROV panel. Synchronized mode is achieved using a hydraulic flow splitter. When independent mode is selected, one of the winch drums can be operated in either direction. The winch selected will be determined by another valve.

Brake Mode:

This is selectable and deselectable on the winch mounted ROY panel via a valve operated by the ROV manipulator. The status of this valve can be set to ON or AUTOMATIC. When selected as ON, this valve prevents rotation of the winches, whichever mode the winches are in at the time of selection.

Winch Selector:

This is selectable and deselectable on the winch mounted ROV panel via a valve operated by the ROV manipulator. The status of this valve can be set to winch 1, winch 2, both or off. The purpose of this valve is to select the winch being operated. The selected winch or winches are operable in either direction.

Direction Select:

This is selectable or deselectable on the winch mounted ROV panel via a valve operated by the ROV manipulator. The status of this valve can be set to In or Out. The setting of this valve determines the direction of rotation of the winches, whichever mode the winches are in at the time of selection.

Contingency Mode:

In the event of loss of hydraulics within the winch system, the ability to complete the connector pull-in operation is achieved by, for example, a class 4 torque buckets (or torque-tool), with suitable gearbox and clutch, located on the outer face of each winch. Load read-out is duplicated, visible by ROV, at each torque bucket location.

Speed Control:

Winch speed is controlled topside by altering the hydraulic pressure and flow delivered from the ROV, with proportional control.

The URA 2 is adapted to accommodate the subsea winch pull-in system 6. In particular, the space between the connector porch 23 and the underside of the steelwork for receiving the main buoyancy tank 1 enables "line of sight" guide chutes 24 to be installed for the subsea winch pull-in cables 18 and provides increased space for disconnection of the winch cable anchors. The landing platform 5 for the subsea winch also serves as a goose neck protection frame. A load bearing interface between the URA 2 and the subsea winch frame 5 has the capacity to transmit at least a 15 metric ton pull-in load.

The flexible riser connection and disconnection operations will now be described.

Figure 11:
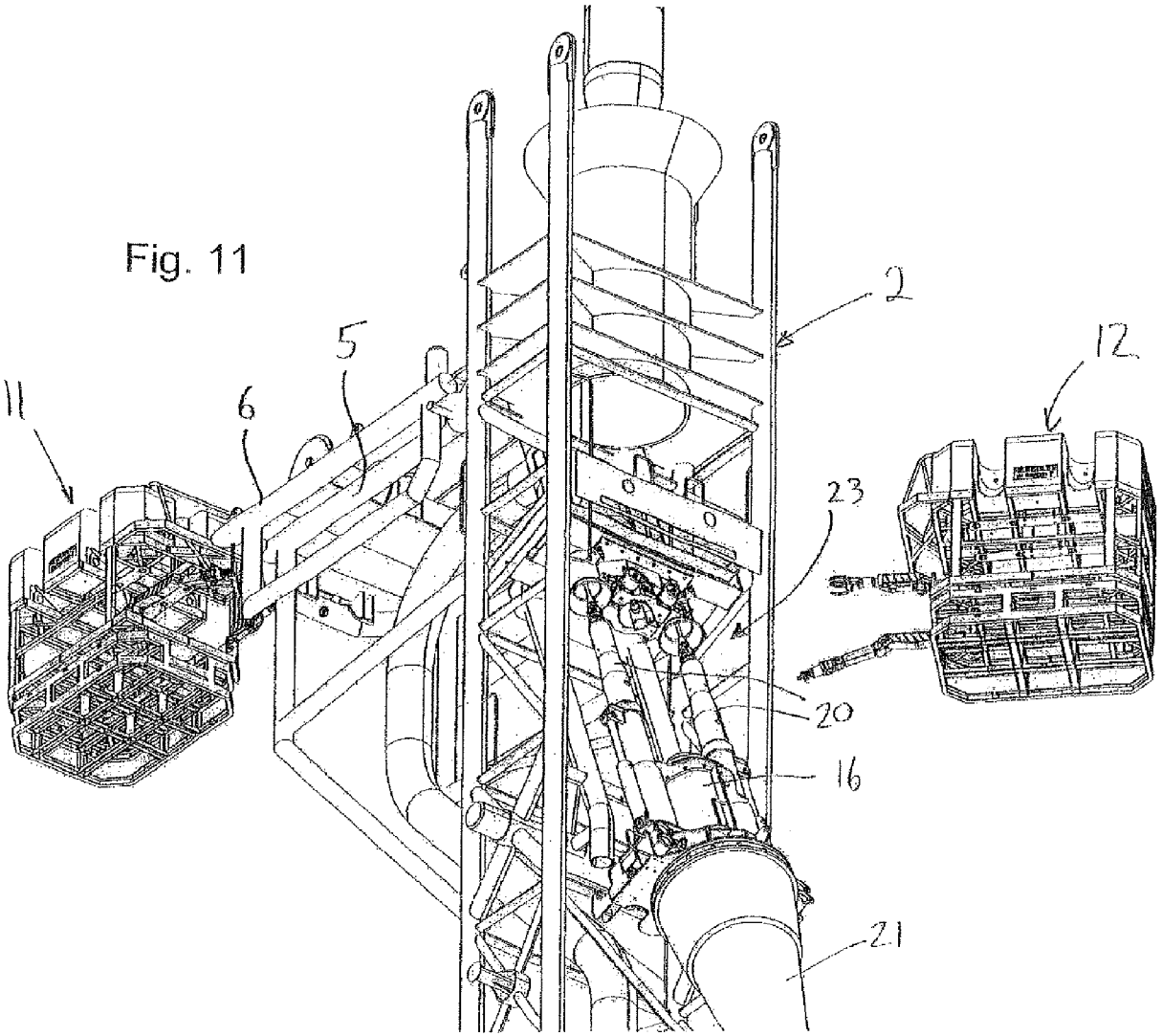
FIG. 11 shows the porch region of the upper riser assembly, as the upper riser part is winched into position, in a perspective view.

In outline, the riser connection operation involves docking the subsea winch platform 6, which houses dual winches 9*a* and 9*b*, onto the landing frame 5 of the URA 2 and securing it with the aid of a remotely operated vehicles (ROVs) 11 or 12. The winch cables 18, with male ball-type connectors at their ends, are then routed through the guide chutes 24 on respective sides of the goose neck 4 so that they protrude just below the lower face of the porch 22 on the URA 2. The flexible riser 15, provided with a riser connector 16 and probes 20 at its end, is then lowered from a support vessel to the correct depth and raised by its connector 16 to form a catenary with the aid of a lifting crane. One ROV then transports both winch cables 18 from the URA 2 and inserts the ball-type connectors into female receptacles on the connector probes 20. Once the flexible riser weight is transferred to the winch cables 18 from the crane wire 7, the pull-in operation can commence until both probes 20 are located in the URA docking station and secured with locking pins by the ROV. The final stage of the pull-in operation is illustrated in FIG. 11.

This method of installation offers the possibility of flexible riser replacement during the lifetime of the given oil field without having to recover the complete SLHR string. Divers are not required and the operation can therefore be carried out in water depths that exceed current diving capabilities.

As shown in FIG. 1, the winch platform 6 is lowered from the support vessel (not shown) to the vicinity of the landing frame 5 of the URA 2. One ROV 12, taking an active role, maintains the heading of the winch platform 6 as the structure approaches the landing frame 5. The other ROV 11 serves as an observer.

Figure 2:
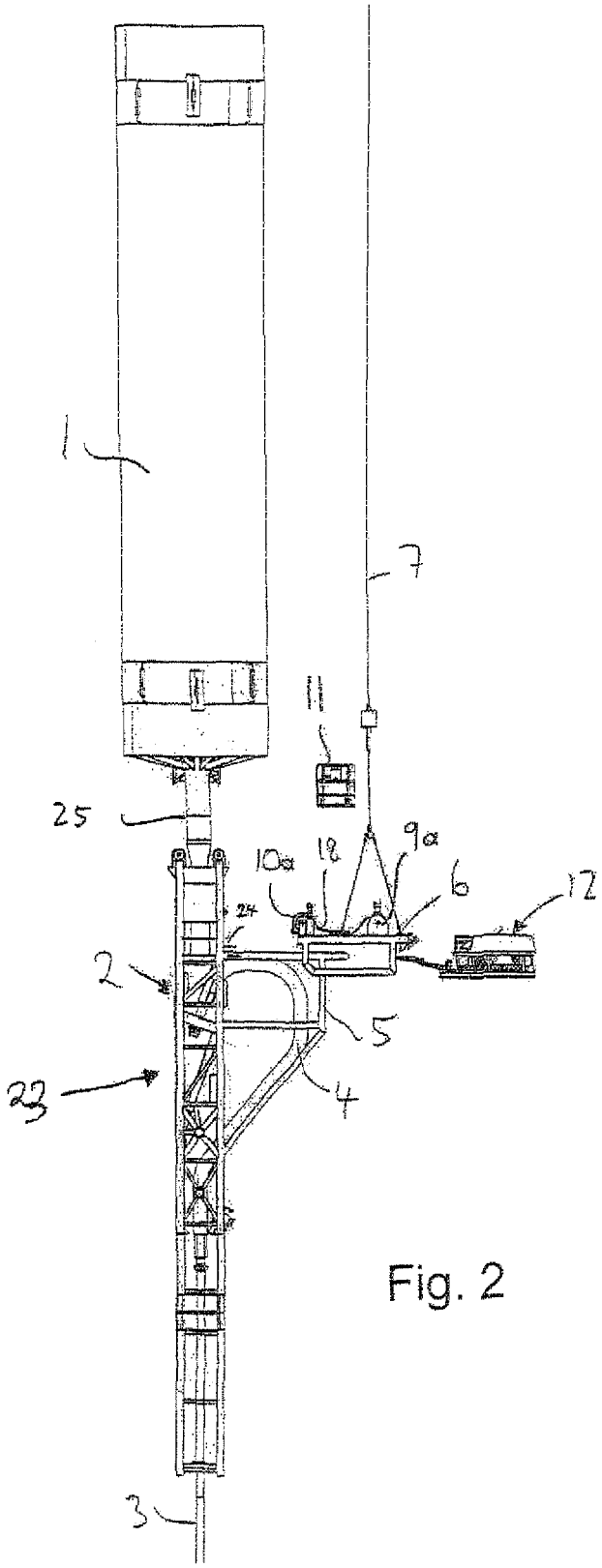

Turning now to FIG. 2, the final approach of the winch platform 6 to the docking position on the landing frame 5 is illustrated. The winch platform 6 is maintained at a small elevation above the landing frame 5, as it is guided horizontally by the ROV 12.

Figure 3:
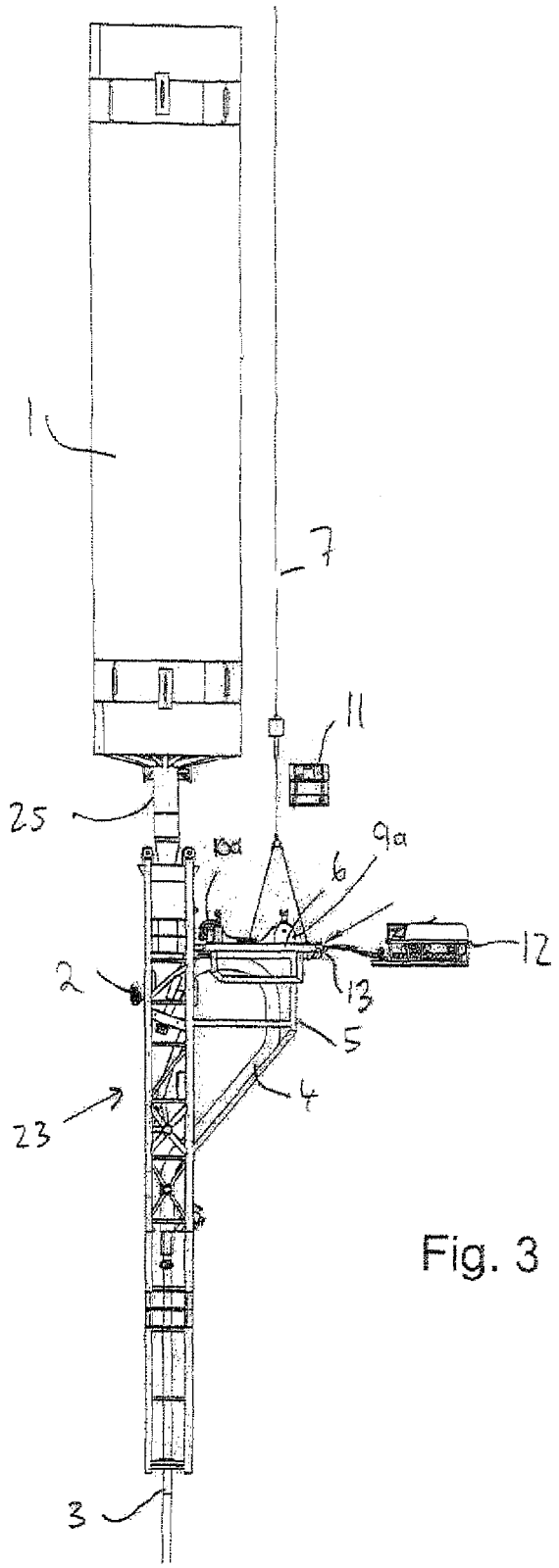
Figure 10:
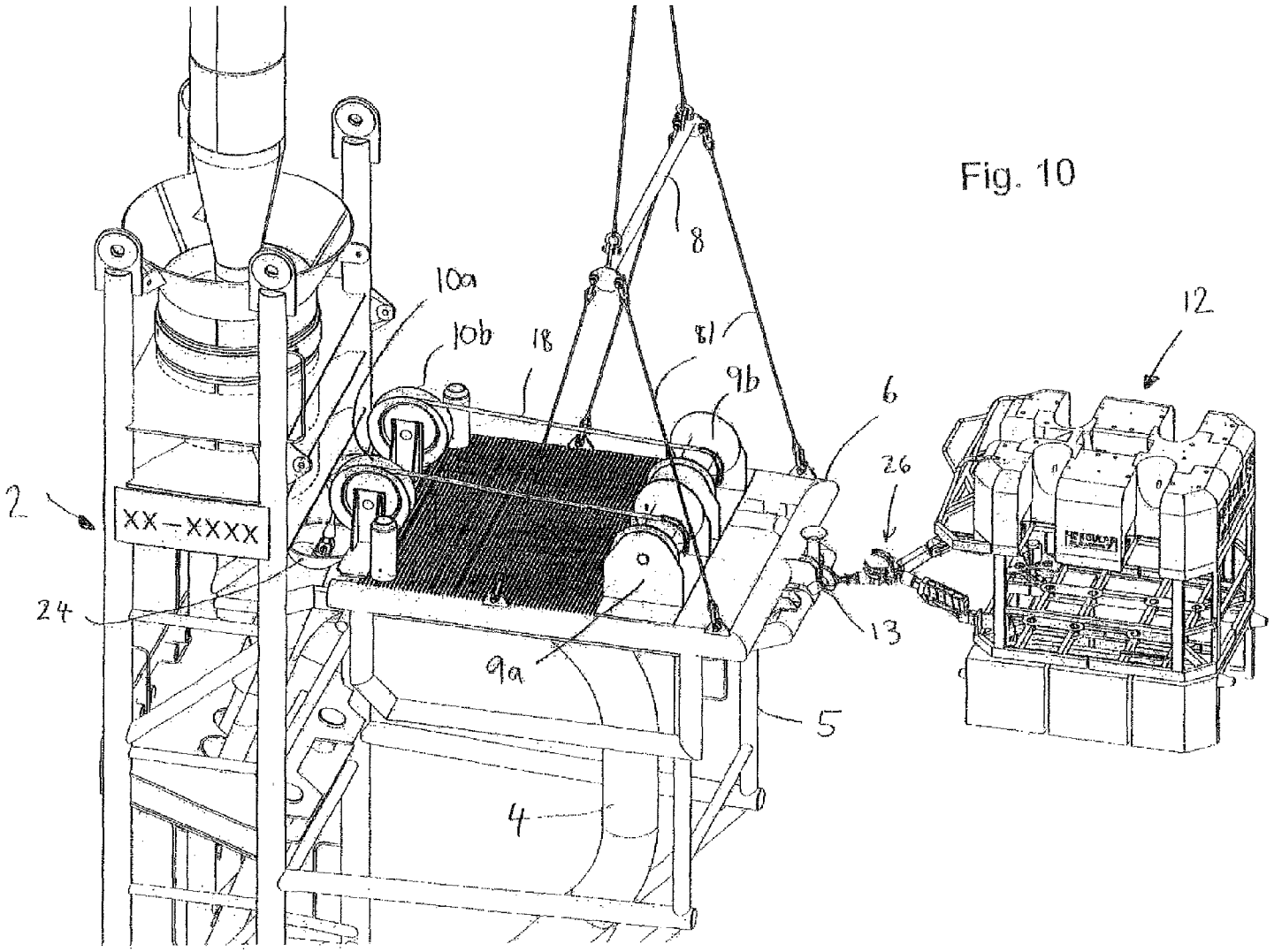
FIG. 10 shows installation of the winch platform onto the upper riser assembly, in a perspective view.

As shown in FIG. 3, after the winch platform 6 is docked against bumpers on the landing frame, and lowered onto the landing frame 5, the ROV 12 locks the winch platform 6 using a pin and socket mechanism at 13, which is not illustrated in detail in FIG. 3, but is shown in FIG. 10.

Figure 4:
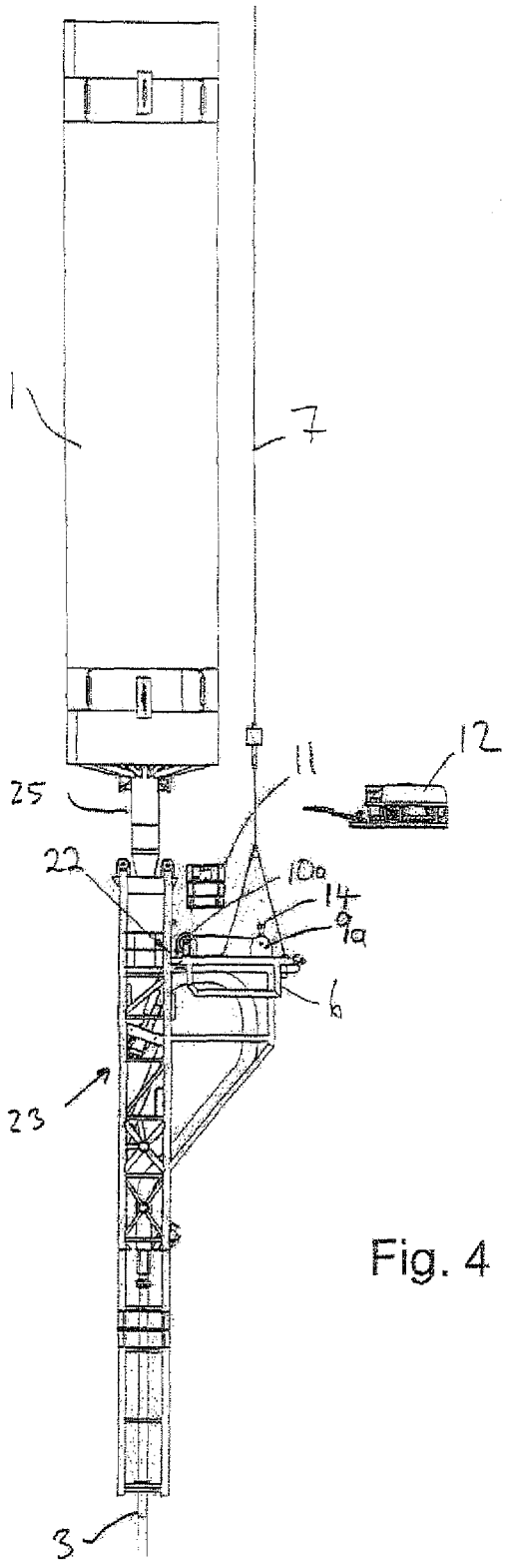

The operation of installing the winch cables 18 will now be described with reference to FIG. 4. Each of the winches 9*a* and 9*b* carries a respective cable 18 which is terminated by a ball connector. As shown in FIG. 4 the active ROV 11 removes the ball connectors from their storage receptacles and places them into respective guide chutes 24 which extend along respective sides of the inclined end portion of the goose neck 4. The winch cables 18 are positioned over respective sheaves 10*a* and 10*b* mounted on the platform 6, as shown clearly in FIG. 11.

Figure 5:
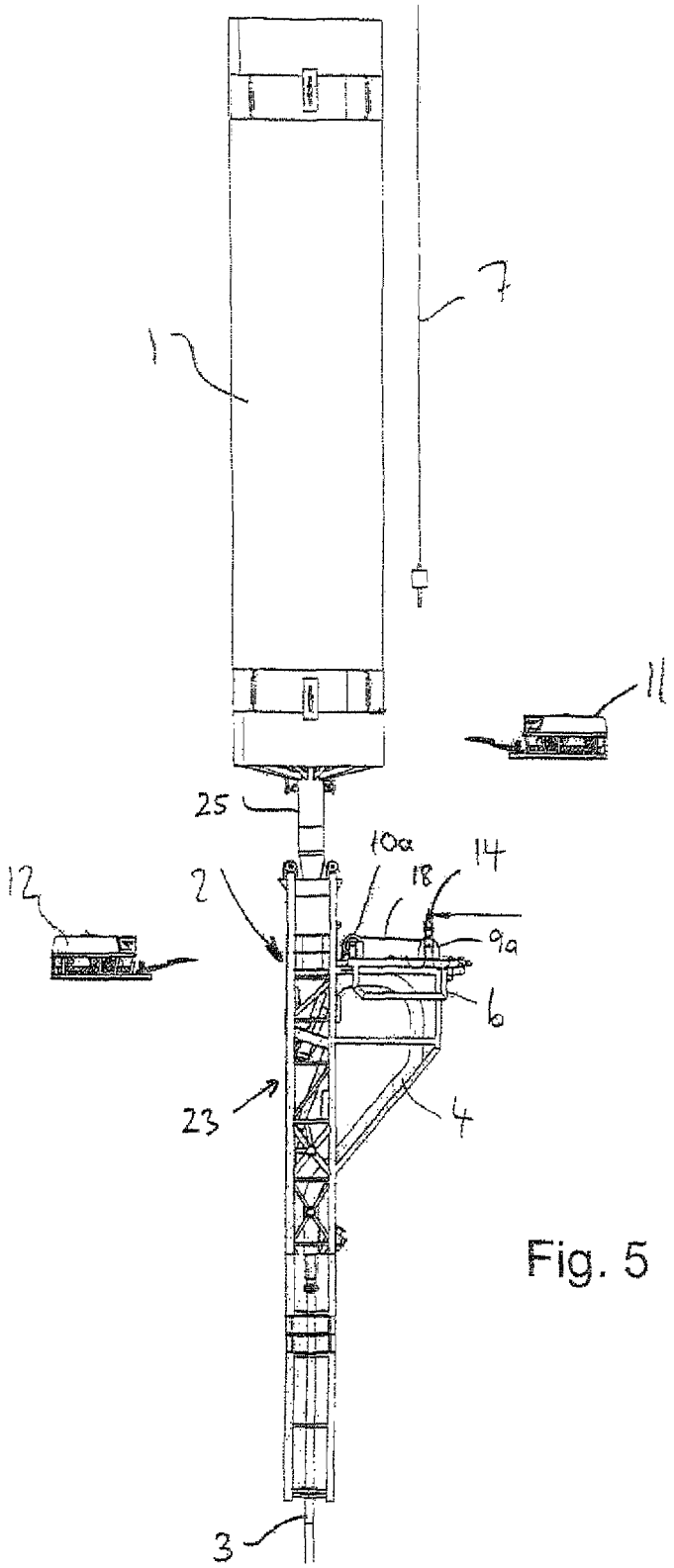

Referring now to FIG. 5, the active ROV 11 then disconnects the crane wire 7 from the winch platform rigging and stores the spreader beam 8 (where provided) in a cradle 14 above the winches 9*a*, 9*b* (not shown in FIG. 11). The crane wire 7 is then recovered to the support vessel.

The support vessel then relocates to a position on the opposite side of the URA 2 and stands off at a distance of about 50 to 100 meters.

Figure 6:
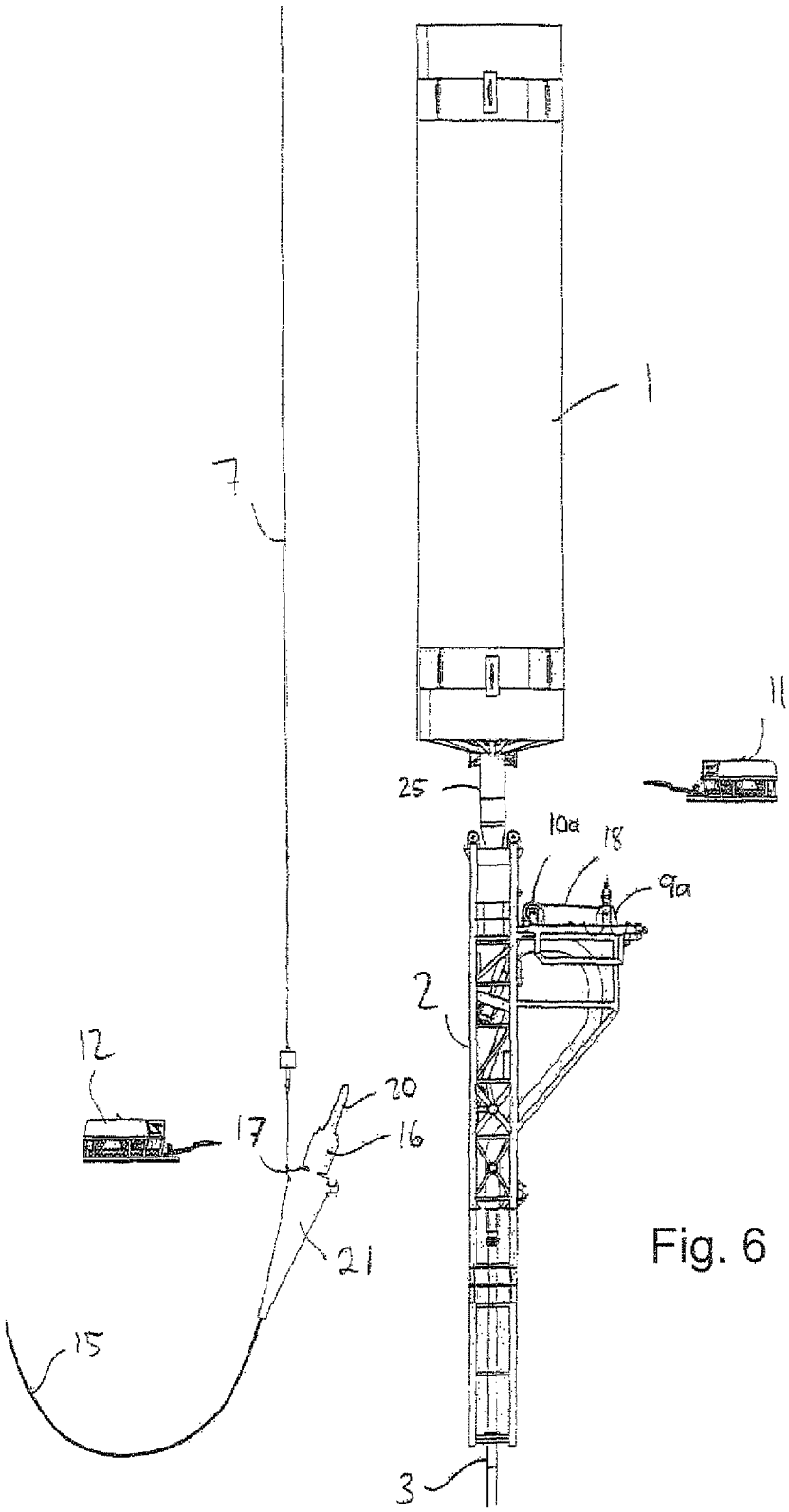

Referring now to FIG. 6, there is optionally an initial lowering and rising of the crane wire 7 in order to measure its twist. The twist in future operations may then be compensated for. The support vessel then lowers the flexible riser component 15, carrying a stiffener 21 and a riser connector 16, to a position adjacent the upper riser assembly 2. The support vessel then lowers the crane wire 7 towards the riser connector 16 so that the ROV 12 can attach the crane wire 7 to a pad eye 17 on the body of the connector 16. The wire 7 is then pulled in by the crane in order to lift the connector 16 and form the flexible riser component 15 into a catenary. The vessel is then stepped in until the connector 16 is approximately 30 m from the URA 2.

Figure 7:
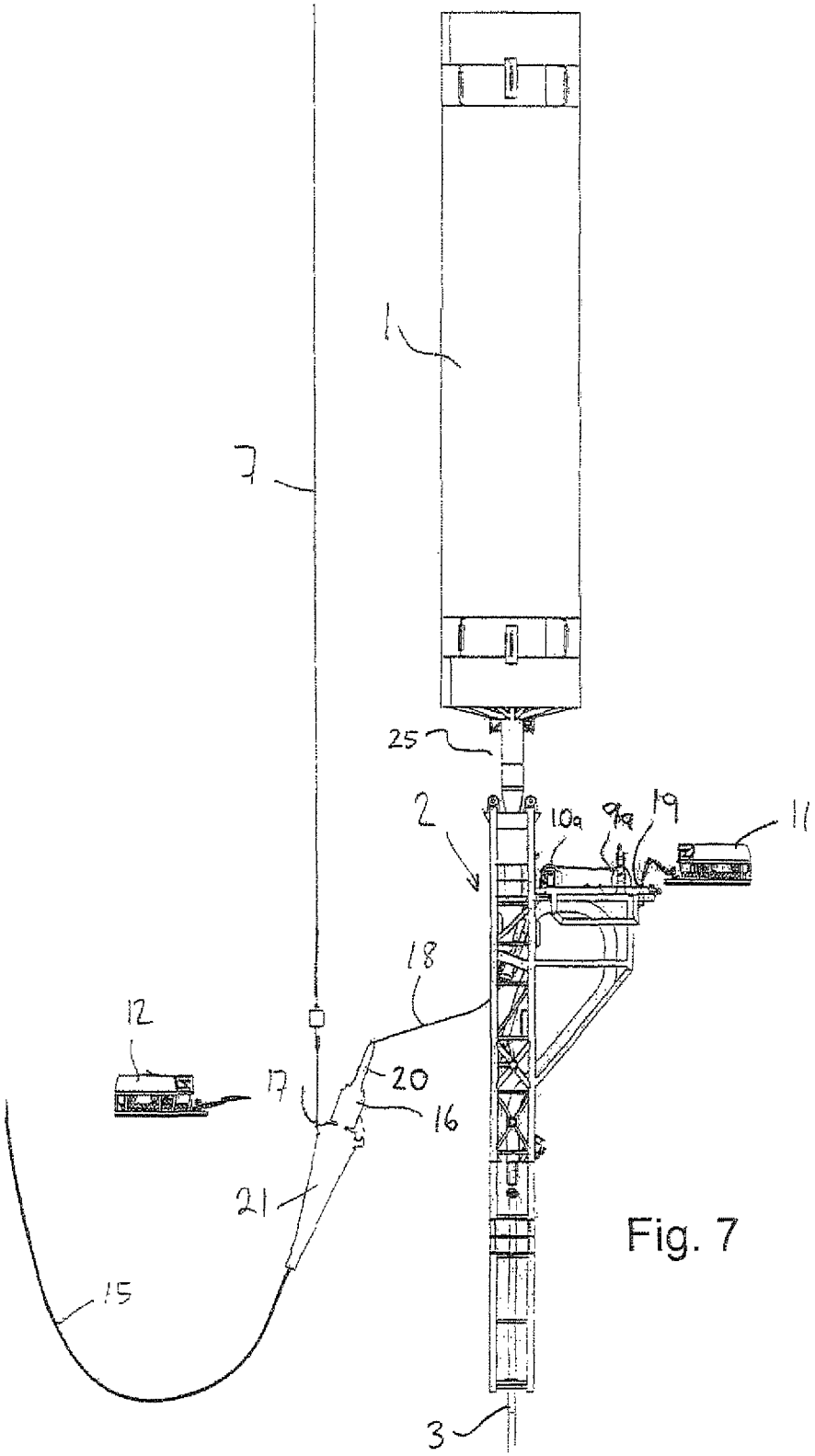

Reference is now made to FIG. 7. As shown, one ROV 11 is coupled to a control panel 19 on the winch platform 6 in order to supply hydraulic power to the winches. The winches are operated to pay out cable 18, thus allowing the ball connectors to descend through the guide chutes 24. The other ROV 12 then collects the ball connectors one at a time and flies across to the upturned flexible connector 16. The ROV 12 inserts each ball connector into a respective female socket on a respective flexible riser connector probe 20 and locks it in place.

The crane on the support vessel is then operated to pay out a further length of cable 7 in order to transfer the weight of the riser 15 and its connector 16 to the winch cables 18. The active ROV 12 then disconnects the slack crane wire 7 from the flexible riser connector 16, to produce the situation illustrated in FIG. 8. The slack crane wire 7 is then retrieved to the support vessel.

Figure 8:
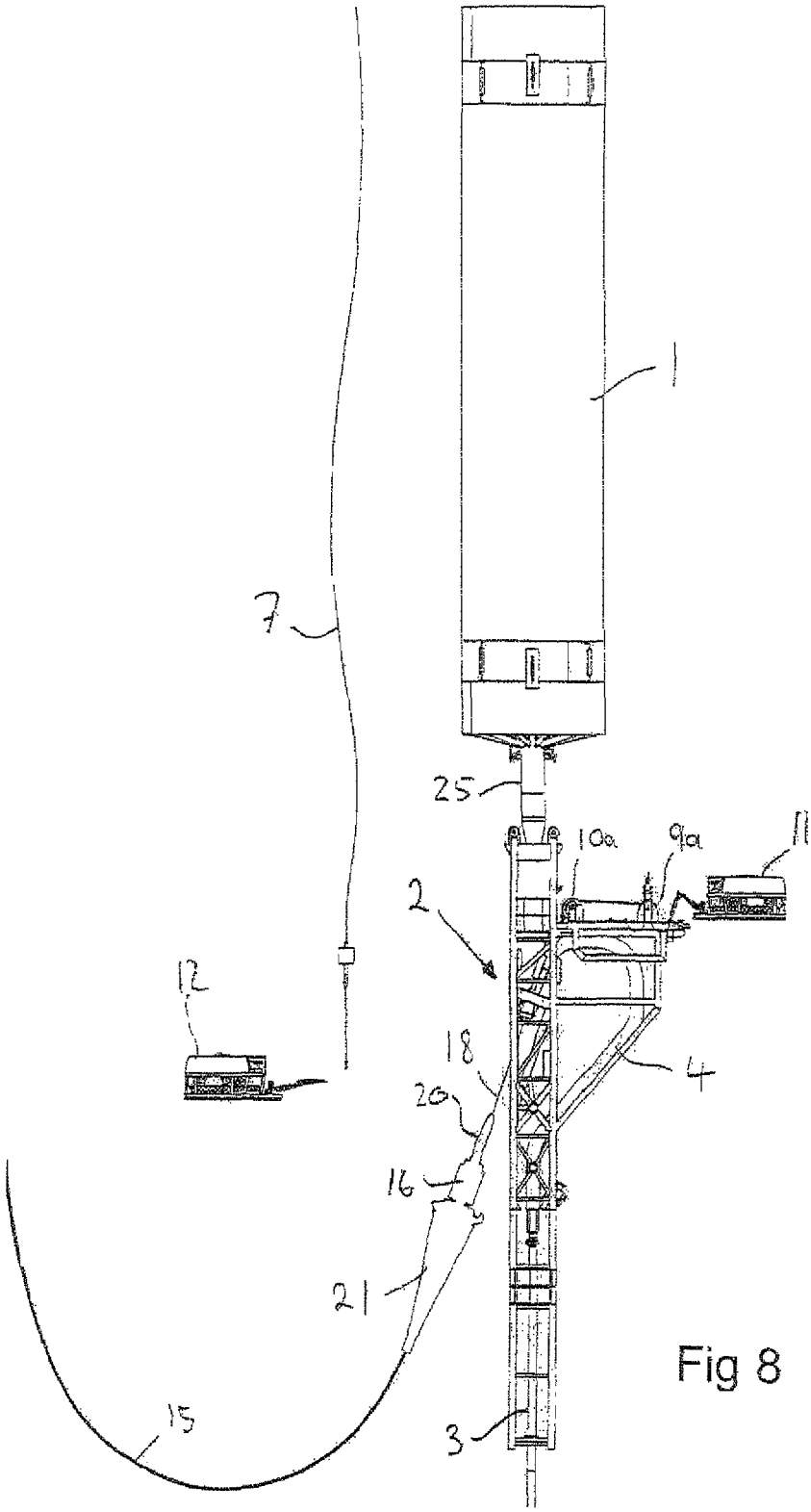

The final stage of the installation is then performed as illustrated in FIGS. 8 and 11. The ROV 11 operates the winches 9*a*, 9*b* so that the flexible riser 15 and its connector 16 are winched up into the upper riser assembly where the ROV 12 locks the probes 20 in place and completes the mating connection between the connector 16 and the goose neck 4. The ball connectors are released and retrieved back to the winch platform 6 where they are replaced into their receptacles by the ROV 11.

Figure 9:
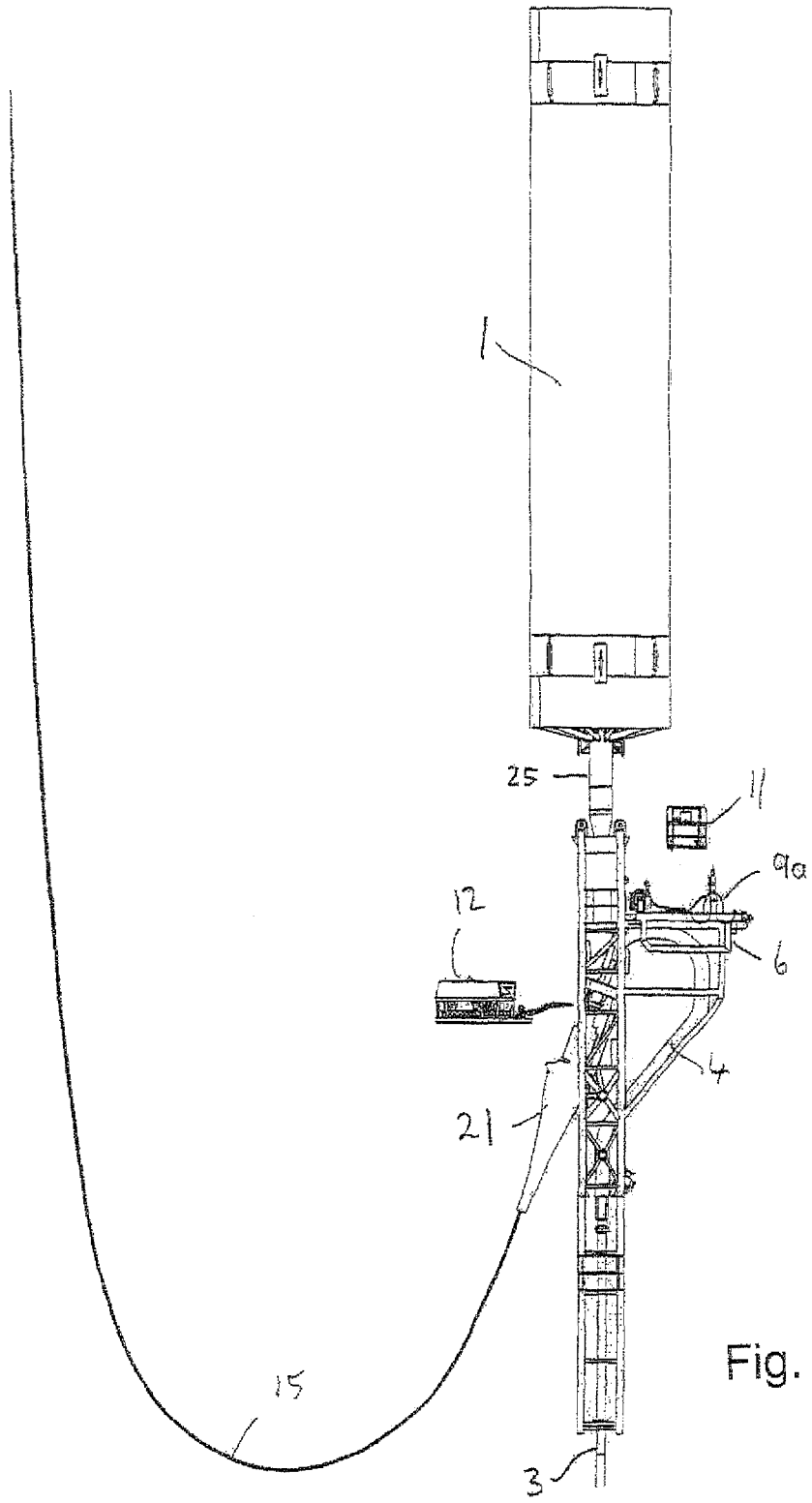

Referring now to FIG. 9, once the transfer of load from crane to subsea winch wires 18 is complete, the flexible first end is pulled in and latched in position by two pins inserted into both probes on the connector. The ROV 12 with underslung skid latches itself securely to the front of the URA and extends a skid tool into the URA frame at an approximately 20° angle to retrieve the blind hub at the end of the goose neck 4 below the porch 23 which hub is subsequently recovered to deck. The ROV 12 then returns to the work site and recovers the debris cap on the flexible end. Both the inboard and outboard hubs are inspected and their integrity verified. The ROV 12 then repositions and secures one of its manipulators 25 onto a grab handle located on the connector 16 and then hot stabs into a hydraulic port on the connector 16 to operate the cylinders which will bring the hub faces together. After this operation the ROV 12 is repositioned and docked onto the URA 2 before operating class 5 torque tools to close a Retiok clamp which in turn seals the two hub faces together. The ROV 12 is then repositioned and secured to another grab handle before operating a class 4 torque tool to secure foot clamps which prevent the transfer of bending moments into the connector 16.

Once the above is completed the ROV 12 repositions and secures itself to the URA 2 to complete a back seal test on the Retlok clamp to prove the seal between the hub faces.

The crane wire 7 can then be re-attached to the winch platform 6. The winch platform 6 can then be disconnected from the landing frame 5, drawn away from the URA 2 by the ROV 11 or 12, and then winched back to the surface vessel.

Accordingly, this method of installation offers the possibility of flexible change out during the life of the field without the need to recover the complete SLHR string. The operation can be performed remotely and does not require the use of divers and can thus be carried out at water depths which exceed current diving capabilities.

In a variant of the method, the ball connectors at the ends of the winch cables 18 are coupled to the connector 16 while it is suspended vertically below the riser section 15, i.e. without the preliminary step of raising the connector 16 by means of the crane cable 7. However, this renders the operation of inserting the ball connectors into their sockets, using the ROV, more difficult.

It is important that the cable linkage 18 should be such as to maintain the connector 16 in a stable orientation while it is pulled into the docking station on the URA 2. In particular it is important to prevent the connector 16 spinning about its longitudinal axis. A convenient way of achieving this result is to make use of two separate cables drawn in by two independently driven winches, with the two cables connected to respective probes 20 on opposite sides of the connector 16, as in the preferred illustrated embodiment.

An alternative method would be to use just a single cable linkage 18 drawn in by a single winch on the winch platform 6, and to achieve the necessary stability by attaching floats to one side of the riser connector 16.

The upper riser part 15 can be disconnected from the lower riser part 3 and retrieved to the surface vessel by a sequence of operations complementary to those described above, as described in the following.

In outline, the operation of disconnecting the upper riser connector 16 involves docking the subsea winch platform 6, which houses dual winches 9*a* and 9*b*, onto the landing frame 5 of the URA 2 and securing it with the aid of remotely operated vehicles (ROVs) 11 and 12. The winch cables 18, with male ball-type connectors at their ends, are then routed through the guide tubes on respective sides of the goose neck 4 so that they protrude just below the lower face of the porch on the URA 2. The ROV then inserts the ball-type connectors into female receptacles on the connector probes 20. The locking pins securing the probes 20 are released by the ROV, and then the flexible riser is lowered by the winch cables 18 away from the porch. The crane wire 7 is then reattached to the connector 16 and the weight of the upper riser and connector 16 taken by the crane wire 7, thus slackening the winch cables 18 and allowing the ROV to disconnect the cables 18 from the probes 20.

Looking at the individual steps in more detail, initially with reference to FIG. 1, the winch platform 6 is lowered from the support vessel (not shown) to the vicinity of the landing frame 5 of the URA 2. One ROV 12, taking an active role, maintains the heading of the winch platform 6 as the structure approaches the landing frame 5. The other ROV 11 serves as an observer.

Turning now to FIG. 2, the final approach of the winch platform 6 to the docking position on the landing frame 5 is illustrated. The winch platform 6 is maintained at a small elevation above the landing frame 5, and is guided horizontally by the ROV 12.

As shown in FIG. 3, after the winch platform 6 is docked against bumpers on the landing frame, and lowered into position, the ROV 12 locks the winch platform 6 using the pin and socket mechanism at 13, which is not illustrated in detail in FIG. 3.

The winch cables 18 are now installed, as previously described with reference to FIG. 4. As shown in FIG. 4 the active ROV 11 removes the ball connectors from their storage receptacles and places them into the respective guide chutes 24 which extend along respective sides of the inclined end portion of the goose neck 4. The winch cables 18 are positioned over respective sheaves 10*a* and 10*b* mounted on the platform 6, as shown clearly in FIG. 11.

Referring now to FIG. 5, the active ROV 11 then disconnects the crane wire 7 from the winch platform rigging and stores the spreader beam 8 (where provided) in the cradle 14 above the winches 9*a*, 9*b* (not shown in FIG. 11). The crane wire 7 is then recovered to the support vessel.

The support vessel then relocates to a position on the opposite side of the URA 2 and stands off at a distance of about 50 to 100 meters.

The ROV 12 then unlocks the probes 20 and decouples the mating connection between the connector 16 and the goose neck 4. The ROV 12 operates the winches 9*a*, 9*b* so that the flexible riser 15 and its connector 16 are winched down from the porch 23 of the upper riser assembly 2. The surface vessel then lowers the crane wire 7 towards the riser connector 16 so that the ROV 12 can attach the crane wire 7 to the pad eye 17 on the body of the connector 16. The wire 7 is then pulled in by the crane in order to lift the connector 16. The ball connectors are released and retrieved back to the winch platform 6 where they are replaced into their receptacles by the ROV 11.

The crane on the support vessel is then operated to pay out a further length of wire 7 in order to lower the connector 16 and allow the crane wire 7 to become slack. The active ROV 12 then disconnects the slack crane wire 7 from the riser connector 16.

The upper riser component 15 can then be retrieved to the surface vessel.

The crane wire 7 can then be re-attached to the winch platform 6. The winch platform 6 can then be disconnected from the landing frame 5, drawn away from the URA 2 by the ROV 11 or 12, and then winched back to the surface vessel.

Whilst the invention is mainly applicable to FSHR systems in which the goose neck or other lower riser termination is located below the buoyancy tank, it would equally be applicable to systems in which the goose neck, or other lower riser termination, is located above the buoyancy tank.

Similarly, although the invention has particular utility for use at a depth below that at which divers can safely operate, it would naturally equally be applicable at shallower depths, e.g. less than 200 m.

Even within diver depth, there are significant advantages of using ROVs, e.g. avoiding exposing divers to high wire loads. Diver safety is a significant issue, and the cost of deploying a diver team is also considerable. These costs and risks associated with use of divers can thus be avoided by use of ROVs.

In the illustrated embodiment, the process of winching the upper riser connector 16 into the docking location on the URA 2 is working against gravity and pulling the connector 16 up into its coupling position for coupling to the goose neck 4.

However, the situation is somewhat different if another type of lower riser connector were to be employed, e.g. a termination which is directed upwardly rather than downwardly at about 20°.

If an upwardly directed termination is employed, a crane may lower the connector under gravity into the docking location, but it nevertheless remains important to stabilize the orientation of the connector, to prevent spinning and to manage the coupling operation without damaging the delicate outer skin of the flexible riser or its coupling surface.

The winching cables can here be of assistance in drawing in the connector against the forces created by the drag of the suspended upper riser as the connector is lowered into the docking position by the crane.

The invention claimed is:

1. A method of connecting a flexible upper riser of a hybrid riser to a lower riser via an upper riser assembly supporting a riser termination on the upper end of the lower riser, the flexible upper riser being connected, in mid-water, to continue the lower riser to a surface facility, the method comprising:

landing a removably attached, submerged winching system on a landing frame attached to the upper riser assembly;

lowering the flexible upper riser and a riser connector at the lower end of the flexible upper riser to a position adjacent the upper riser assembly;

securing a cable linkage to the riser connector;

operating the winching system on the upper riser assembly to wind in the cable linkage and draw the riser connector into a docking position on the upper riser assembly; and coupling the riser connector to the riser termination.

2. The method according to claim 1, further comprising: disconnecting the cable linkage from the riser connector.

3. The method according to claim 1 in which said cable linkage comprises two or more winch cables.

4. The method according to claim 1 in which a winch platform carrying said winching system is lowered to the upper riser assembly and docked with the upper riser assembly by means of a remotely operated vehicle.

5. The method according to claim 4, in which a further remotely operated vehicle provides power to the winching system.

6. The method according to claim 1 in which the flexible upper riser and the riser connector are lowered into a position adjacent the upper riser assembly, the riser connector is hoisted up by a lifting device to form a catenary in the upper riser part, and a weight of the flexible upper riser and its riser connector is transferred to the cable linkage before the riser connector is drawn into said docking position.

7. The method according to claim 1 in which a remotely operated vehicle is employed to secure the cable linkage to the riser connector, to couple the riser connector to the riser termination and to disconnect the cable linkage from the riser connector.

8. The method according to claim 7 in which all connection and disconnection operations are performed with at least one remotely operated vehicle.

9. The method according to claim 1 in which said riser termination comprises a goose neck and said cable linkage is threaded through ducts alongside the goose neck by means of a remotely operated vehicle.

10. The method according to claim 1 in which the upper riser assembly is suspended from a buoyancy tank.

11. A method of disconnecting the flexible upper riser of a hybrid riser from a lower riser via an upper riser assembly supporting a riser termination on an upper end of the lower riser, the flexible upper riser being connected, in mid-water, to continue the lower riser to a surface facility, the method comprising:

landing a removably attached, submerged winching system on a landing frame attached to the upper riser assembly;

securing a cable linkage to a riser connector at the lower end of the flexible upper riser;

decoupling the riser connector from the riser termination;

operating the winching system on the upper riser assembly to unwind the cable linkage and withdraw the riser connector from its docking position on the upper riser assembly; and retrieving the flexible upper riser and its riser connector from a position adjacent the upper riser assembly.

12. The method according to claim 11, further comprising: disconnecting the cable linkage from the riser connector after it has been withdrawn from the docking position.

13. The method according to claim 11 in which said cable linkage comprises two or more winch cables.

14. The method according to claim 11 in which a winch platform carrying said winching system is lowered to the upper riser assembly and docked with the upper riser assembly by means of a remotely operated vehicle.

15. The method according to claim 14, in which a further remotely operated vehicle provides power to the winching system.

16. The method according to claim 11 in which the riser connector is hoisted up by a lifting device and a weight of the flexible upper riser and its riser connector is transferred from the cable linkage to the lifting device after the riser connector is withdrawn from said docking position.

17. The method according to claim 11 in which a remotely operated vehicle is employed to secure the cable linkage to the riser connector, to decouple the riser connector from the riser termination and to disconnect the cable linkage from the riser connector.

18. The method according to claim 17 in which all connection and disconnection operations are performed with at least one remotely operated vehicle.

19. The method according to claim 11 in which said riser termination comprises a goose neck and said cable linkage is threaded through ducts alongside the goose neck by means of a remotely operated vehicle.

20. The method according to claim 11 in which the upper riser assembly is suspended from a buoyancy tank.

* * * * *